US006104586A

United States Patent [19]

Robinson

[11] Patent Number: 6,104,586

[45] Date of Patent: Aug. 15, 2000

[54] CIRCUIT BREAKER SWITCH APPARATUS

[75] Inventor: Darrell Robinson, Highland Township, Mich.

[73] Assignee: Ekstrom Industries, Inc., Farmington Hills, Mich.

[21] Appl. No.: 09/196,257

[22] Filed: Nov. 19, 1998

Related U.S. Application Data

[60] Provisional application No. 60/066,271, Nov. 20, 1997.

[51] Int. Cl.[7] ..... H04H 3/00

[52] U.S. Cl. ..... 361/102; 361/663; 439/517

[58] Field of Search ..... 361/659–668, 361/93.1, 102; 439/517

[56] References Cited

U.S. PATENT DOCUMENTS

| | | |
|---|---|---|
| Re. 34,531 | 2/1994 | Bell et al. . |
| D. 349,686 | 8/1994 | Robinson et al. . |
| 3,031,640 | 1/1962 | McKee . |
| 3,061,763 | 10/1962 | Ekstrom . |
| 3,221,216 | 11/1965 | Kobryner . |
| 3,596,234 | 7/1971 | Supienza . |
| 4,772,213 | 9/1988 | Bell et al. . |
| 4,977,482 | 12/1990 | Patton . |
| 5,023,747 | 6/1991 | Lindsay . |
| 5,088,004 | 2/1992 | Howell . |
| 5,145,403 | 9/1992 | Schaffert et al. . |
| 5,145,422 | 9/1992 | Fry . |
| 5,181,166 | 1/1993 | Howell . |
| 5,207,595 | 5/1993 | Learmont et al. . |
| 5,385,486 | 1/1995 | Robinson et al. . |
| 5,423,695 | 6/1995 | Robinson et al. . |
| 5,546,269 | 8/1996 | Robinson et al. . |
| 5,571,031 | 11/1996 | Robinson et al. . |
| 5,572,396 | 11/1996 | Robinson . |
| 5,577,933 | 11/1996 | Robinson et al. . |
| 5,586,913 | 12/1996 | Robinson et al. . |
| 5,588,874 | 12/1996 | Pruehs . |
| 5,590,179 | 12/1996 | Shincovich et al. . |
| 5,704,804 | 1/1998 | Robinson et al. . |

OTHER PUBLICATIONS

Series and Switch Adapters Series 37 and 700, five models, Ekstrom Industries Inc., Bulletin EI–RA–191–5M (No Date).

Temporary Metered Powser Device Models TMP–2600 and TMP–2649, Ekstrom Industries, Inc. (No Date).

Service Limiter Adapter Ekstrom Industries, Inc., Bulletin EL–SL–191–5M (No Date).

Series Reconnect Device Series SRD–S1900, Scientific Atlanta Instrumentation Group, 1992.

*Primary Examiner*—Michael J. Sherry
*Attorney, Agent, or Firm*—Young & Basile, PC

[57] ABSTRACT

A circuit breaker switch apparatus pluggable into a watthour meter socket includes at least one set of line and load contact terminals and a power disconnect for completing an electrical circuit between at least one line terminal and one load terminal. The power disconnect switch is responsive to a trigger signal to switch switchable contacts to an open position and maintains the switchable contacts in the open position as long as the trigger signal is present. The power disconnect switch is mountable in the socket adapter housing by a snap-in connection. Load jaw contacts are mounted on rigid bus bars which are connectable to the power disconnect switch by a snap-in connection. An insulating shield surrounds the line and load jaw contacts and conductors while providing apertures to allow the insertion of watthour meter blade terminals therethrough into contact with the jaw contacts.

18 Claims, 10 Drawing Sheets

FIG-1
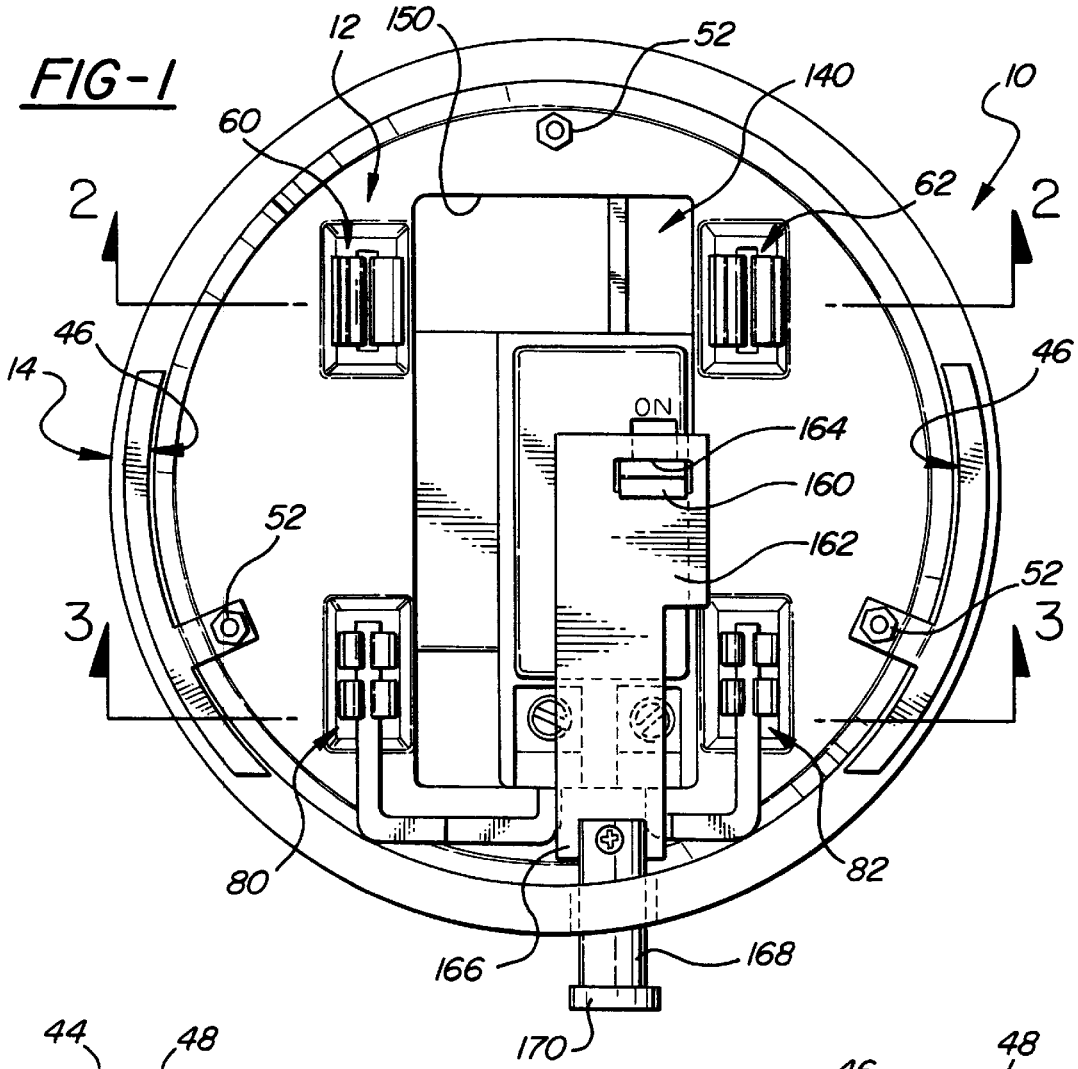
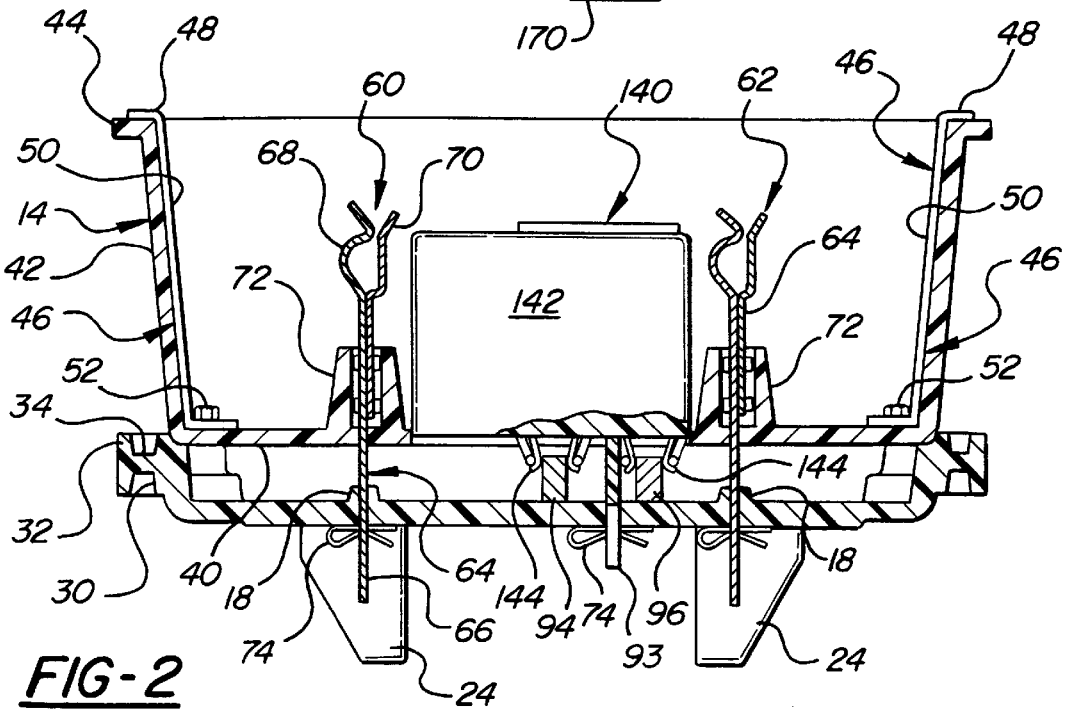
FIG-2

10
12
14
16
18
24
40
42
46
72
74
80
82
84
86
88
90
92
94
96
98
100
102
104
106
120
122
136
140
146
150
152
154
156
160

258
248
226
142
160
258
248
226
280
278
140
226
274
252
246
284
280
262
274
292
286
146
146
264
294
296
294
293
291
288
242
290
240

CIRCUIT BREAKER SWITCH APPARATUS

CROSS REFERENCE TO CO-PENDING APPLICATIONS

Applicant hereby claims the benefit of the priority date of United States provisional application Ser. No. 60/066,271 filed Nov. 20, 1997 in the name of Darrell Robinson and entitled "Circuit Breaker Switch Apparatus," the contents of which are incorporated herein in their entirety.

Applicant hereby cites co-pending U.S. patent applications Ser. No. 09/148,253 filed Sep. 4, 1998 in the name of Darrell Robinson et al, entitled "Jaw Blades For Watthour Meter Socket Adapter" and serial number 09/182,167 filed Oct. 29, 1998 in the name of Darrell Robinson et al, and entitled "Watthour Meter Socket Adapter" as claiming subject matter also disclosed in the present application.

BACKGROUND OF THE INVENTION

1. Field of the Invention

The present invention relates, in general, to electric power service to homes and buildings and, more specifically, to watthour meters and meter socket adapters mountable in watthour meter sockets at homes and buildings.

2. Description of the Art

Electrical power is supplied to an individual site or service by external electrical power line conductors located above or below ground. In a conventional arrangement, electrical power line conductors are connected to contacts in a watthour meter socket mounted on a building wall. Electrical load conductors are connected to another set of contacts in the meter socket and extend to the electrical distribution network in the building. A watthour meter is connected into the contacts in the meter socket to measure the electric power drawn through the load conductors.

Due to the current trend toward the use of plug-in watthour meters, extender type socket adapters have been devised which allow the addition of equipment and features not originally intended for the electrical service. Such watthour meter socket adapters have been constructed as service limiting adapters and provided with power disconnect devices, such as circuit breakers or ground fault circuit interrupters, both for protecting the electrical service as well as, in certain applications, to limit the amount of power supplied to the use site.

It is common in the electrical utility industry to frequently disconnect electrical service to a particularly user site. Such service disconnection can be for non-payment, seasonal usage, or rental units in high turnaround areas, such as college campuses, mobile home parks and apartments, etc. Typically, when it is desired to disconnect electrical service to a particular user site, a utility meter person goes out to the particular user site and removes the watthour meter. Another meter person must be sent out to re-install a meter to reconnect service to the user site. This sequence is labor intensive and, therefore, expensive.

The remote watthour meter reading controllers now being installed in electrical distribution networks have the capability of remote disconnect and reconnect. It is also known to provide such meter reading controllers and service limiting adapters with external signals to enable the electrical power utility to selectively activate a relay in the adapter to disconnect power to a specific use site. Such externally controlled relays have typically used low level DC voltage signals which switch the relay in the socket adapter to an "off" position opening the current path through the line and load circuits.

Many electric utilities have rules that will not allow a reconnection of a meter if the electric customer is not at home or if the main power disconnect is not turned off. This is for safety reasons since a box or other combustible material could be left on a stove that may be switched on and could start a fire when the meter is reconnected. Combustible material may be left near a turned on electric heating source or a water pump which is turned on, but not primed, both creating potential fire hazards when the watthour meter is reconnected.

Even when electric power is allowed to be turned back on when the electric customer is not home, a standard test out procedure is commonly employed to make sure there is no hazards or faults, such as miswired service or a back feed condition, such as occurs when power is borrowed from a neighbor for temporary use. The test out procedure is also performed since the electric service is typically only protected for faults or overcurrents at the primary, such as the primary of a transformer servicing many customers. This can allow many times the available power if the meter is reconnected into a fault condition.

The new switch adapters used to disconnect and reconnect electric power service do not have overcurrent protection. Such switch adapters can be wired to allow the switch to be reset at the adapter with an add-on electrical pushbutton or plunger. This would place the electric customer in the position of reconnecting electric power at the socket without testing for a fault. This is a situation which many utility companies would not presently allow thereby requiring the meter service person to preform tests because of the potential fire and safety hazards.

Such power disconnects or circuit breakers have been mounted in a watthour meter socket adapter housing by means of fasteners, such as nuts and bolts. As circuit breakers are sized to protect the service entrance conductors, circuit breakers have been previously available in a number of current trip capacities, such as 60, 100, or 150 amp service. Any upgrade in the service current carrying capability would require a different circuit breaker. This necessarily would then require a new socket adapter with the new circuit breaker or the removal of the circuit breaker from the existing socket adapter at a service site and the mounting of a new circuit breaker with a higher current rating in the socket adapter housing.

Present technology is now able to make power disconnect switches or circuit breakers operable up to 160 amps continuous service. It would be desirable to provide a circuit breaker or power disconnect switch for a watthour meter socket adapter which can carry the highest possible continuous current and still be mountable within an existing socket adapter housing without significant modification to the housing.

Separate from the electrical utility industry, shunt type circuit breakers are used as electrical control devices. Such shunt type circuit breakers have input terminals to which 120/240 VAC may be applied to trigger the circuit breaker coil and switch the circuit breaker contacts from closed to open positions. When power is applied to the trigger terminals of shunt type circuit breakers, the shunt type circuit breaker goes into a stand-by condition which prevents the manual actuator on the circuit breaker from being pushed to a reset position to close the internal circuit breaker contacts which would allow the reapplication of power to the use site. However, once power is removed from the trigger circuit, the circuit breaker can be manually reset to the power "on" or contacts closed position.

As such, it would be desirable to provide a circuit breaker switch apparatus which includes means for mounting a circuit breaker in a watthour meter socket adapter which is capable of operating with 120/240 VAC input trigger signals. It would also be desirable to provide a means for mounting a shunt type circuit breaker in a watthour meter socket adapter without extensive modification to the existing socket adapter housing. It would be desirable to provide a limiting electrical service adapter which includes means for safely remotely disconnecting and reconnecting electrical power to a use site. It would also be desirable to provide a circuit breaker switch apparatus which can be removably mounted in a watthour meter socket adapter housing, through a snap in connection. It would also be desirable to provide a circuit breaker for mounting in a watthour meter socket adapter which enables higher current rated bus bar type electrical conductors to be easily and quickly attached to the circuit breaker terminals.

SUMMARY OF THE INVENTION

The present invention is a circuit breaker switch apparatus which provides unique control over the power service at a user site in a power distribution network.

The circuit breaker switch apparatus is pluggable with a watthour meter socket and has line and load terminals such as line and load jaw contacts and line and load blade terminals mounted in a housing. A power disconnect means is disposed in the housing and has a plurality of contacts switchable between an electrically conductive closed position and an electrically disconnected open position. The switchable contacts are electrically connected between at least one of the line and load terminal or jaw contact and one other of the line and load terminal or blade terminals. Means are also provided for selectively completing an electrical circuit between at least one line jaw contact and one load blade terminal. The power disconnect means automatically switches the switchable contacts to the open position when the rate of power through the power disconnect means exceeds a preset level of power, i.e., overcurrent or overvoltage. The circuit completing means maintains the electrical circuit continuously open upon the continuous application of a trigger signal or voltage to the power disconnect means.

Preferably, the power disconnect means is a shunt-type power disconnect having trigger terminals which receive an external trigger signal or voltage for automatically switching the switchable contacts of the power disconnect means to the open position and maintaining the switchable contacts in the open position as long as the trigger signal or voltage is present.

Snap-in connection means are formed in the housing and on the power disconnect means for removably mounting the power disconnect means or switch in the housing in a snap in connection thereby facilitating easy replacement of the power disconnect switch in the event of a power upgrade at the utility site or for repair.

A one piece plunger is coupled to the actuator of the power disconnect switch and has an end extending externally through an aperture of the housing when the power disconnect switch is in the open position. The plunger enables movement of the actuator to cause closure of the switchable contacts of the power disconnect means.

The housing of the socket adapter may be formed as a two part, interconnected base and shell, or as a one piece unitary member formed of a base, annular sidewall extending from the base, and mounting flanges formed on the exterior end of the sidewall and near the juncture of the base and the sidewall.

An insulating safety shield is mountable in the housing and surrounds substantially all of the line and load jaw contacts and the line and load conductors. Apertures are formed in the shield at the location of the line and load jaw contacts to allow the insertion of a watthour meter blade terminals therethrough into contact with the underlying jaw contacts. An aperture is formed in the shield to allow the shield to be mounted about the power disconnect switch.

The circuit breaker switch apparatus of the present invention uniquely provides a shunt-type circuit breaker or power disconnect switch which is pluggable into a watthour meter socket. This facilitates the control of electrical power service to a user site through the application of the external trigger signal to the circuit breaker. The trigger signal may be provided by the utility, automatic meter reading equipment, or from another power distribution authority, such as a management office in a trailer park, marina, etc.

The circuit breaker switch apparatus is easily mounted in the housing via a snap-in connection thereby facilitating removal and replacement of the circuit breaker in the event of a damaged circuit breaker or in a power service upgrade.

BRIEF DESCRIPTION OF THE DRAWING

The various features, advantages and other uses of the present invention will become more apparent by referring to the following detailed description and drawing in which:

FIG. 1 is a front elevational view of a watthour meter socket adapter having a circuit breaker switch apparatus of the present invention mounted therein;

FIG. 2 is a cross-sectional view generally taken along line 2—2 of FIG. 1;

DESCRIPTION OF THE PREFERRED EMBODIMENTS

In order to better describe and appreciate the advantages of the present invention, a description of the conventional construction of an electric watthour meter socket adapter or socket extender/adapter, both hereafter referred to as a socket adapter, and a watthour meter and meter socket will be provided with reference to FIGS. 1–4. A conventional watthour meter socket adapter 10 is designed to receive a conventional electric watthour meter, not shown, in a snap in connection via mating contacts and terminals. The socket adapter 10 also includes contacts described hereafter, which plug into mating contacts in a watthour meter socket. The number of contacts on the socket adapter 10, the watthour meter and the meter socket will vary depending upon the type of electric service at a particular user site. FIGS. 1–4 depict, by way of example only, a single phase electric service.

Figure 3:
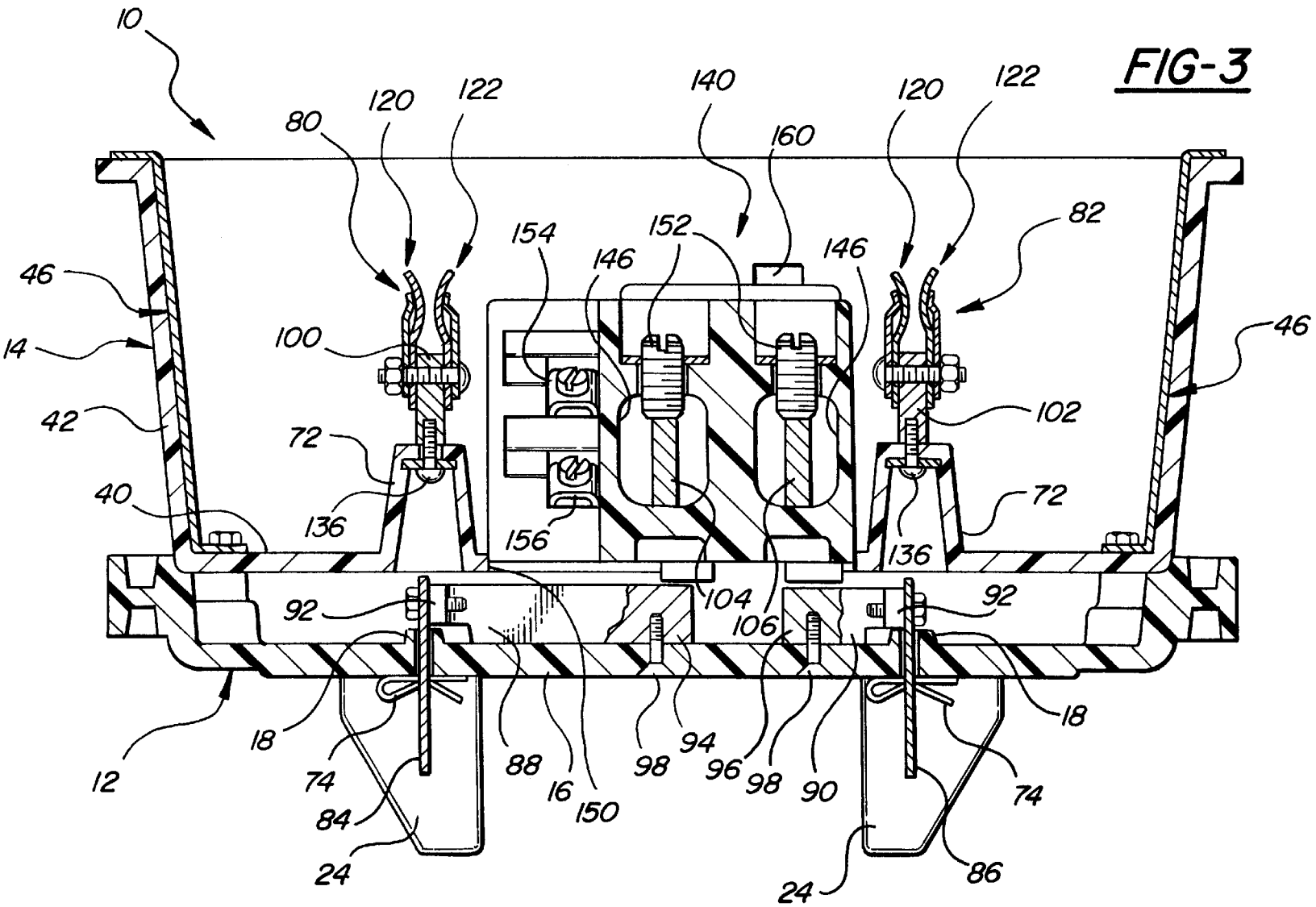
FIG. 3 is a cross-sectional view generally taken along line 3—3 in FIG. 1.

As shown in FIGS. 1–4, the socket adapter 10 includes a base portion 12 and a shell portion 14 which are fixedly joined together by suitable means, such as fasteners. The base 12 has a central wall 16 of generally circular shape. A plurality of generally rectangular bosses 18 are formed on the central wall 16. Each of the bosses 18 has a slot 20 formed therein which extends completely through each boss 18 and the central wall 16 to receive a blade terminal therethrough, as described hereafter. A plurality of cylindrical bosses 22 are also formed on and extend outward from one surface of the central wall 16. Through bores are formed in each boss 22 for receiving a fastener to join the shell 14 to the base 12. A plurality of outwardly extending legs 24, shown in FIGS. 2 and 3, are formed on a back surface of the wall 16 and are provided in an appropriate number and are spaced from one of the blade terminals which extends through the base 12.

An annular, raised, inner peripheral edge flange 30 is formed on the base 12 and extends outward from one surface of the central wall 16. An outer peripheral edge flange 32 is spaced radially outward from the inner flange 30. A plurality of circumferentially spaced ribs 34 extend radially between the inner and outer peripheral edge flanges 30 and 32.

The inner peripheral edge flange 30 includes an annular seat for receiving a peripheral edge portion of the shell 14 when the shell 14 is joined to the base 12. The outer peripheral edge flange 32 extends radially outward from the inner edge flange 30 and forms a mounting flange which mates with the mounting flange on a ring style cover of a watthour meter socket, not shown. A conventional sealing ring, also not shown, is employed to surround and lockingly join the outer peripheral edge flange 32 to the mounting flange on the socket.

The shell 14 of the socket adapter 10 is formed with a bottom wall 40 and a generally annular sidewall 42. The sidewall 42 terminates in an enlarged diameter exterior end mounting flange 44. The mounting flange 44 is designed to mate with a corresponding mounting flange on a conventional watthour meter, not shown. A sealing ring, also not shown, is employed to encompass and lockingly connect the mounting flange 44 on the shell 14 and the mounting flange on a watthour meter.

A pair of ground straps 46 are mounted on opposite sides of the shell 14. Each ground strap 46 has a peripheral edge portion 48 mounted on and extending over an edge of the exterior end mounting flange 44. A connector strap 50 is joined to the edge portion 48 and extends along the interior of the sidewall 42 of the shell 14 to a connection on the bottom wall 40 of the shell 14. The ground straps 46 provide a ground connection to the high voltage surge suppression circuit of the watthour meter.

Fasteners 52 extend through the bottom portion of the connector strap 50 and into the bosses 22 in the base 12 to securely mount the shell 14 on the base 12. An additional fastener 52, shown in FIG. 1, extends straight through the bottom wall 40 of the shell 14 into the underlying boss 22 in the base 12.

A plurality of contact terminals, such as jaw type contacts are mounted in the shell 14. The contacts may be provided in any number depending upon the type of electrical service provided to a particular user site. In the exemplary, single phase embodiment, a pair of line jaw contacts 60 and 62 and a pair of load jaw contacts 80 and 82 are mounted in the shell 14.

Each line jaw contact 60 and 62, as shown in greater detail in FIGS. 1, and 2 has a female jaw portion designed to receive a blade terminal of a watthour meter in a plug-in, snap-together connection. Although each line jaw contact 60 and 62 may have a folded-over jaw design formed of two inward folded ends which define a separable aperture for receiving a blade terminal of a watthour meter therein, in an exemplary embodiment, each line jaw contact 60 and 62 is formed of a single jaw blade 64 having a blade terminal end 66 and an opposed jaw contact end 68. A spring clip 70 is riveted or joined to an intermediate portion of the jaw blade 64. The spring clip 70 has a jaw end spaced from the jaw contact end 68 of the jaw blade 64 to form a slot designed to receive a blade terminal of a watthour meter therein.

Each jaw blade 64 extends through a slot in a generally rectangular boss 72 formed on and extending outward from the bottom wall 40 of the shell 14 and one aligned slot 20 in one of the bosses 18 on the central wall 16 of the base 12 as shown in FIG. 2. A fastener, such as a cotter pin 74, extends through an aperture in the end portion of the jaw blade 64 to securely position the jaw blade 64 in the socket adapter 10, with the blade terminal end 66 projecting rearwardly outward from the central wall 16 of the base 12 for engagement with a jaw contact in a watthour meter socket.

The load service in the watthour meter socket adapter 10 includes load contact terminals, such as the pair of load jaw contacts 80 and 82 and a pair of load blade terminals 84 and 86. A power disconnect means, described hereafter, has its switchable contacts switchably connected by conductors between the load jaw contact 80 and the load blade terminal 86 and between the jaw contact 82 and the low blade terminal 84 to selectively control the flow of power through the load side of the socket adapter.

The load blade terminals 84 and 86 are of conventional, planar construction and are secured in position in the mounting bosses 18 on the central wall 16 of the base 12 by means of a cotter pin 74, which extends through an aperture formed in each load blade terminal 84 and 86. In this position, as shown in FIG. 3, each load blade terminal 84 and 86 has an end portion positioned for releasible engagement with a jaw contact in a watthour meter socket, not shown, in the same manner as the line jaw blades 66. An opposite end of each load jaw blade terminal 84 and 86 projects inwardly through the boss 18 on the central wall 16 of the base 12 into an interior space between the central wall 16 and the bottom wall 40 of the shell 14 as also shown in FIG. 3.

Figure 4:
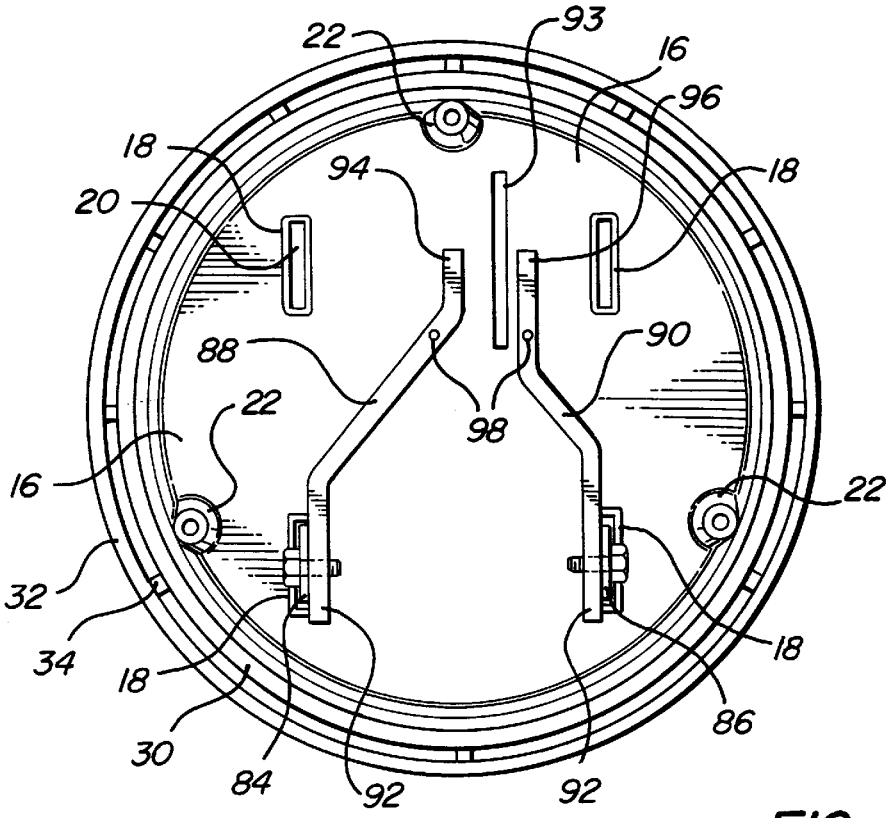
FIG. 4 is a front elevational view of the base of the watthour meter socket adapter shown in FIG. 1, with the shell and circuit breaker removed.

As shown in FIGS. 3 and 4, a first pair of conductors 88 and 90 are mounted in the interior space between the central wall 16 of the base 12 and the bottom wall of 40 of the shell 14. Preferably, each of the first pair of conductors 88 and 90 is in the form of a rigid bus bar having a generally polygonal cross section, such as square, rectangular, etc. One end of each of the conductors 88 and 90 is connected to one of the load jaw blade terminals 84 and 86, as shown in FIG. 4, by means of a fastener 92, such as a screw, which threadingly extends through bores formed in the end of each conductor 88 and 90 and the upper ends of each of the load blade terminals 84 and 86.

The first pair of conductors 88 and 90 is bent in a predetermined configuration as shown in FIG. 4 to position the opposed second ends 94 and 96, respectively, for engagement with jaw contacts on a power disconnect means 140, as described herein. Fasteners, such as threaded screws 98 project through the central wall 16 of the base 12 to fixedly position the second ends 94 and 96 of the conductors 88 and 90 along the central wall 16 of the base 12.

An insulator member or strip 93 is mounted through a slot formed in the central wall 16 of the base 12, as shown in FIGS. 2 and 4, and is positioned between the second ends 94 and 96 of the first pair of conductors 88 and 90 to provide electrical insulation between the two conductors 88 and 90. The insulator member 93 may be held in position by means of a fastener, such as a cotter pin 74 mounted on an exterior side of the insulator member 93 projecting outward from the rear surface of the central wall 16 of the base 12.

Figure 5:
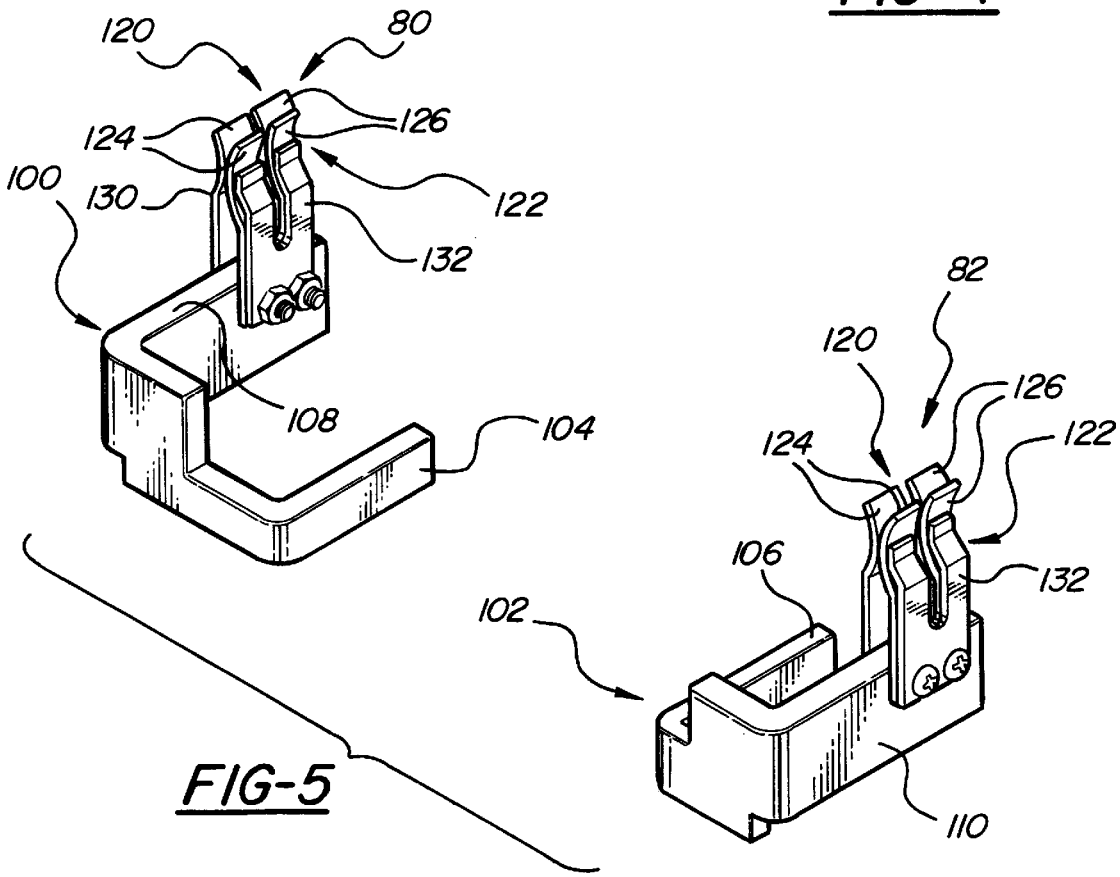
FIG. 5 is a perspective view of the shunt conductors connected to the watthour meter socket adapter load jaw contacts.

A second pair of conductors 100 and 102 is also connected to the power disconnect means 140, described hereafter, and to the load jaw contacts 80 and 82, respectively. As shown in detail in FIG. 5, each of the second pair of conductors 100 and 102 is generally in the form of rigid bus bar having a generally polygonal or rectangular cross section. Each of the second pair of conductors 100 and 102 has a first end 104 and 106, respectively, designed to slidably engage terminals in the power disconnect means 140. Each conductor 100 and 102 is formed with an intermediate step to offset the opposed second end 108 and 110 of each of the conductors 100 and 102 from the first ends 104 and 106. In this manner, the second ends 108 and 110 of each of the conductors 100 and 102, respectively, are positioned to mount the jaw contact 80 and 82 for slidably and releasably receiving a blade terminal of a watthour meter in a snap together connection.

Each load jaw contact 80 and 82 includes a pair of contact clips, 120 and 122, mounted on opposite sides of the second ends 108 and 110, respectively, of the conductors 100 and 102. Each contact clip 120 and 122 may be formed of a single piece member or two separate members. Further, it is preferred that each contact clip 120 and 122 be divided into two spaced contact surfaces or legs 124 and 126 which are alignable with the corresponding legs 124 and 126 of the opposed contact clip 120 or 122 to form a slot about the edge of the conductor 100 or 102 for releasably receiving a blade terminal of a watthour meter.

Means are provided for biasing each contact clip 120 and 122 toward each other with sufficient force to releasably and securely hold a blade terminal of a watthour meter or other electrical device therebetween in a secure electrical connection. The biasing means is preferably in the form of first and second spring clips 130 and 132 respectively associated with the contact clips 120 and 122. The spring clips 130 and 132 are fixably joined at one end of each contact clip 120 and 122 by means of suitable fasteners, such as rivets or the bolts and nuts shown in FIG. 5.

Further details concerning the specific angular construction of the contact clips 120 and 122 and the spring clips 130 and 132 may be had by referring to U.S. Pat. No. 5,577,933, the contents of which pertaining to the construction of the contact clips and spring clips and their mounting on a rigid bus bar is incorporated herein by reference.

As shown in FIG. 3, fasteners, such as a threaded bolt denoted by reference number 136 extends through an aperture formed in one of the bosses 72 projecting inward from the bottom wall 40 of the shell 14 into the second ends 108 and 110 of the second pair of conductors 100 and 102 to fixedly position the second ends 108 and 110 of the second pair of conductors 100 and 102 within the shell 14.

Although the contact clip-spring clip arrangement is described above as a preferred implementation of the load jaw contacts 80 and 82, it will be understood that other jaw contact/blade terminal configurations, such as a conventional folded over jaw contact and planar blade terminal, may also be employed.

The socket adapter 10 also includes the power disconnect means 140 shown in FIGS. 1–3. The power disconnect means 140 is preferably in the form of a series 2 shunt trip circuit breaker, such as a shunt trip circuit breaker sold by Square D Corporation. The power disconnect means 140 is in the form of a generally cubical housing 142 which contains at least one pair of switchable contacts, not shown, connected between a pair of jaw contacts 144 and a pair of terminals 146. The jaw contacts 144 project outward from a rear surface or back wall of the housing 142 and are positioned to releasably mount the power disconnect means 140 on the second ends 94 and 96 of the first pair of conductors 88 and 90, as shown in FIG. 2. It should be noted that the jaw contacts 144 project through an aperture 150 formed generally centrally in the bottom wall 40 of the shell 14 between the mounting bosses 72. The pair of terminals 146 are positioned on a sidewall of the housing 142 to receive the first ends of 104 and 106 of the second pair of conductors 100 and 102 as shown in FIG. 3. Screw type fasteners 152 are threadably extendable through each terminal 146 to secure the ends 104 and 106 of the second pair of conductors 100 and 102 in the terminals 146.

A pair of trigger terminals 154 and 156 are formed in an end or sidewall of the housing 142 of the power disconnect means 140. The trigger terminals 154 and 156 are designed to receive a pair of conductors, not shown, connectable to a source of switched 120 or 240 VAC electric power. The trigger terminals 154 and 156, when 120 VAC or 240 VAC electrical power is applied thereto, activate a coil or solenoid within the power disconnect means or circuit breaker 140 to switch the pair of contacts within the power disconnect means 140 from a closed position to an open position. An actuator 160 is movably mounted on the housing 142 and is switchable along with switching of the circuit breaker contacts between two positions labeled "on" and "off" by indicia on the exterior of the housing 142. The actuator 160 provides an indication of the current carrying state of the switchable contacts of the circuit breaker 140. In addition, the actuator 160 acts as a manual actuator in that the actuator 160 can be moved between the two positions, such as between the "on" and "off" positions or vice versa to manually switch the circuit breaker contacts.

As shown in FIG. 1, a connector 162 has an aperture 164 in one end disposed about the actuator 160 on the power disconnect means 140. A cotter pin or other fastener may be employed to secure the connector 162 to the actuator 160. The connector 162 has an opposed end 166 which is secured by a fastener to a tubular rod 168. The rod 168 movably extends through an aperture in the sidewall 42 of the shell 14 and has an enlarged end or collar 170. The power disconnect means 140 will normally be employed with the switchable contacts in a closed position connecting the first pair of conductors 88 and 90 to the second pair conductors 100 and 102 thereby completing a power circuit through the load side of the watthour meter socket adapter 10. The switchable contacts of the circuit breaker remain closed and the actuator 160 positioned in the "on" position as long as electrical power is disconnected or not applied to the terminals 154 and 156 on the circuit breaker 140. Since the actuator 160, when circuit breaker 140 is in the "on" position, moves to its upward end of travel, the actuator 160 causes the connector 162 to likewise move inward through the top of the shell 14 causing the rod 168 to retract toward the sidewall 42 of the shell 14 as shown in FIG. 1.

As the circuit breaker 140 can be selected with different overcurrent or power trip ratings, such as 100 amps, 120 amps, etc., the circuit breaker 140 is capable of automatically switching its internal contacts from the closed to the open position when an overcurrent condition is sensed on the load conductors 100 and 102. Upon sensing an overcurrent condition or even an overvoltage condition, the circuit breaker 140 switches its internal contacts to an open position thereby opening the circuit between the first pair of load conductors 88 and 90 and the second pair of load conductors 100 and 102 and disconnecting electrical power from the load distribution network.

Further, during such movement of the actuator 160 from the "on" to the "off" position, the actuator 160 causes the connector 162 to likewise move outward through the bottom portion of the annular sidewall 42 of the shell 14. This causes the rod 168 fixed to the connector 162 to extend outward from the annular sidewall 42 of the shell 14. Suitable indicia labeled "off" or a "red" color can be placed on the end of the rod 168 to provide a visible indication, externally of the socket adapter 10, of a power "off" condition of the of the circuit breaker 140.

When the user or the utility company desires to reapply power to the use site, inward directed force need only be applied to the end 170 of the rod 168. This forcibly moves the plunger 160 on the circuit breaker 160 to the "on" position and switches the contacts of the circuit breaker 140 to the "on" position thereby reapplying power to the load distribution network connected to the load blade terminals 84 and 86.

However, the shunt type circuit breaker 140 is constructed such that the actuator 160 can be moved from the "off" to the "on" position only when electrical power is disconnected from the trigger terminals 154 and 156. As long as electrical power is applied to the trigger terminals 154 and 156, the circuit breaker 140 cannot be switched to the "on" position.

At the same time, selective application of 120 VAC or 240 VAC electrical power to the terminals 154 and 156, such as from an external source controlled by the power company or other power control authority, enables the power company to selectively control the "on" or "off" state of the circuit breaker 160. By applying electrical power to the terminals 154 and 156, the utility company can cause the circuit breaker 140 to switch to the "off" position. As long as electrical power is maintained on the trigger terminals 154 and 156, the user cannot reconnect power by attempting to force the rod 168 inward through the shell 42.

Although the circuit breaker 140 has been described as being interconnected between conductors connected to the load jaw contacts 80 and 82 and the load blade terminals 84 and 86, it will be understood that the circuit breaker 140 can also be interconnected between similar conductors connected to separate line jaw contacts and line blade terminals constructed similar to the load jaw contacts and load blade terminals described above.

Referring now to FIGS. 6–14, there is depicted an alternative embodiment of a watthour meter socket adapter 228 having a power disconnect switch mounted therein. The housing 229 of the socket adapter 228 includes a generally planar base or bottom wall 230 and a lower sidewall 232. The sidewall 232 terminates at a radially outward extending mounting flange 234. The mounting flange 234 has an inward extending, annular shelf 236 disposed interiorly within the socket adapter 228 and an outwardly extending flange terminating in a depending lip 238 spaced from the lower sidewall 232. The lip 238 is positioned for receiving a sealing ring to mount the socket adapter 228 on a ring-style socket adapter cover, not shown. An upper sidewall 239 extends from the mounting flange 234 and terminates in a mounting flange 240.

A pair of line jaw blades 226 each have unitary, one piece construction formed of a blade terminal end 242 which is offset by an intermediate offset 244 from an elongated jaw contact end 246. A blade terminal edge guide 248 is formed at one end of the jaw contact end 246.

A pair of side flanges 250 and 252 project perpendicularly from opposite side edges of the jaw contact end 246 and extend from an upper end adjacent the blade terminal guide 248 and to an opposite end 254 approximate the intermediate offset 244. The second end 254 of each side flange 250 and 252 seats on the base 230 of the socket adapter extender 228 to prevent sideways movement of the jaw blade 226 relative to the base 230.

A conventional spring clip 258 is fixedly connected to the jaw contact end 246 by two fasteners, such as rivets, not shown, extendible through the apertures 259. The upper end of the spring clip 258 angles outwardly to form the blade terminal guide 248 on the jaw contact end 246. The end 260 of the spring clip 258 is spaced from the adjacent jaw contact end 246 to define a slot for receiving a watthour meter blade terminal in a conventional manner.

A power disconnect means or circuit breaker 140 is mountable between the line and load jaw contacts and blades terminals in the housing 229 of the socket adapter 228. The line jaw contacts and bus bar connectors as well as the load blade terminals are shown in detail in FIGS. 9–12. The load conductors 262 and 264 are in the form of bus bars having a polygonal or rectangular cross section. The load conductors 262 and 264 are of similar construction and are generally formed as mirror images of each other. Load conductor 262 includes a planar terminal end 266 which is engageable with the power disconnect or circuit breaker 140, as described hereafter. A depending offset 268, shown more clearly in the load conductor 264, projects from the terminal end 266 to a planar mounting portion 270. The planar mounting portion 270 has a generally L-shape and includes a pair of apertures 272 which receive fasteners for fixedly attaching the load conductors 262 and 264 to the bottom wall 230 of the socket adapter housing 229.

An upstanding portion 274 projects from the mounting portion 270 to an outer end 276. An outward angled or curved guide end 278 is formed on the outer end 276 for guiding the insertion of a watthour meter blade terminal into contact with the outer end 276 of each load conductor 262 and 264. A jaw contact denoted generally by reference number 280 is formed by the outer end 276 of each load conductor 262 and 264. A bifurcated contact clip 282 and a biasing spring clip 284 which are fixedly mounted to the outer end 276 of each load conductor 262 and 264 by means of fasteners, such as rivets, not shown, which extend through aligned apertures in the spring clip 284, the bifurcated contact clip 282, and the outer end 276 of the load conductor 262 and 264. It should be noted that the bifurcated contact clip 282 and the bifurcated spring clip 284 are by way of example only as both the contact clips 282 and the spring 284 may each be formed of a solid, non-slotted member.

A pair of load blade conductors 286 and 288 are connected to the power disconnect means or switch 140 and terminate in a blade terminal end 290 which extends outward through the back wall 230 of the housing 229 for insertion into jaw contacts in a watthour meter socket. The load blade conductors 286 and 288 are formed of rigid bus bar with an elongated rectangular configuration. Further, the conductors 286 and 288 are generally similar, but formed as mirror images of each other. Thus, the following description of the conductor 286 will apply equally to the construction of the opposed conductor 288.

A notch 291 is formed between the blade terminal end 290 and a planar extension 293. The notch 291 rests on the bottom wall 230 of the housing 229 to support one blade terminal 286 and 288 in the housing 229. A cotter pin, not shown, is inserted through an aperture in the blade terminal end 290, externally of the housing 229.

An upper end portion 292 projects angularly, or generally perpendicularly from one end of the extension 293. A slot 294 in the end portion 292 forms an outer terminal end 296.

Figure 11:
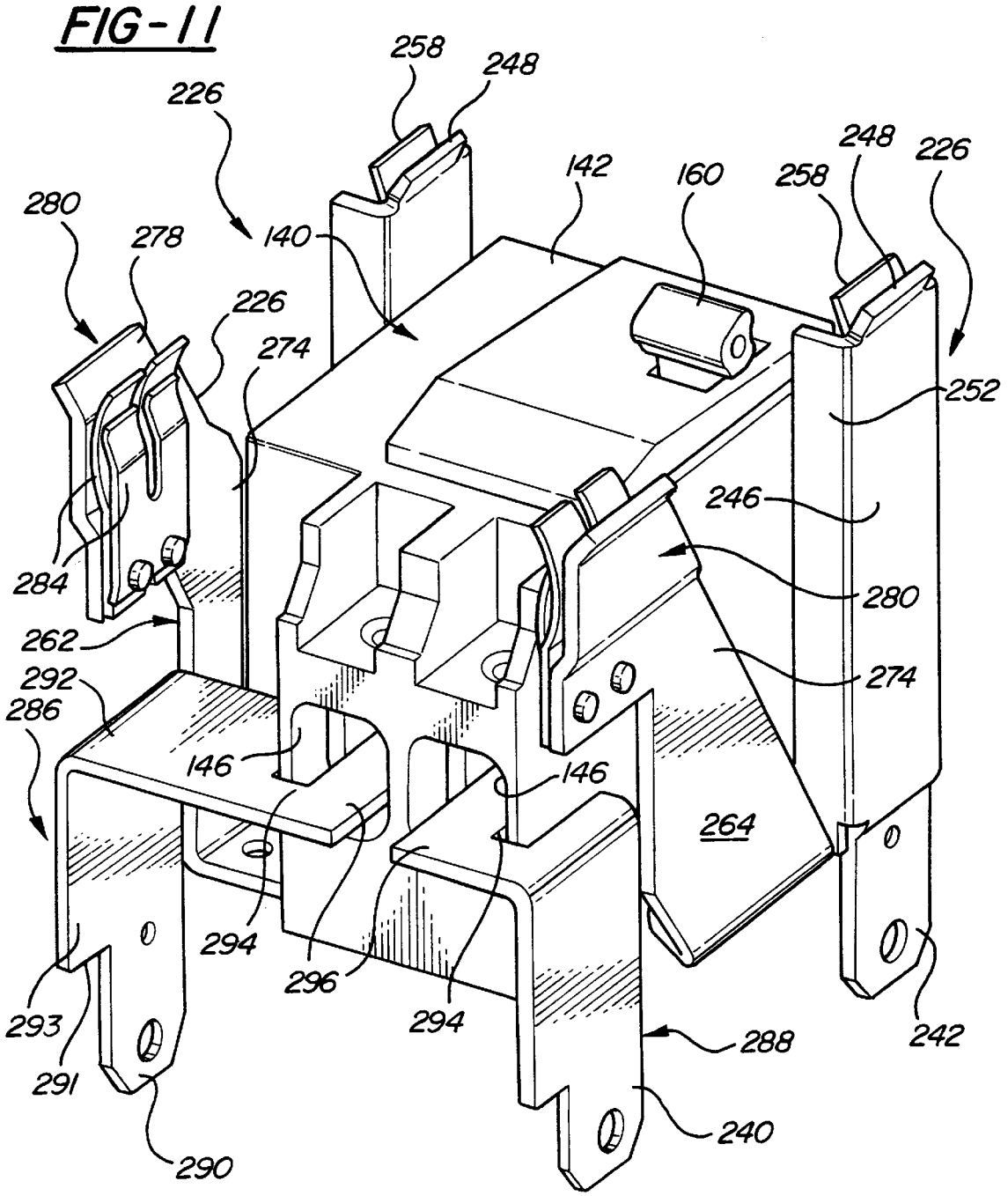
FIG. 11 is a perspective view of the bottom of the circuit breaker showing the position of the load jaw contacts and the load blade terminals with respect to the circuit breaker.

As shown in FIG. 11, the slots 294 in each of the blade terminals 286 and 288 are designed to slide around the sidewalls of the housing of the power disconnect switch 140 to enable each terminal end 296 to be inserted into one of the bores 146 in the housing 142 where it is fixed in position by means of a terminal screw, not shown. In this manner, the blade terminals 286 and 288 are easily mounted to the power disconnect switch 140.

Figure 12:
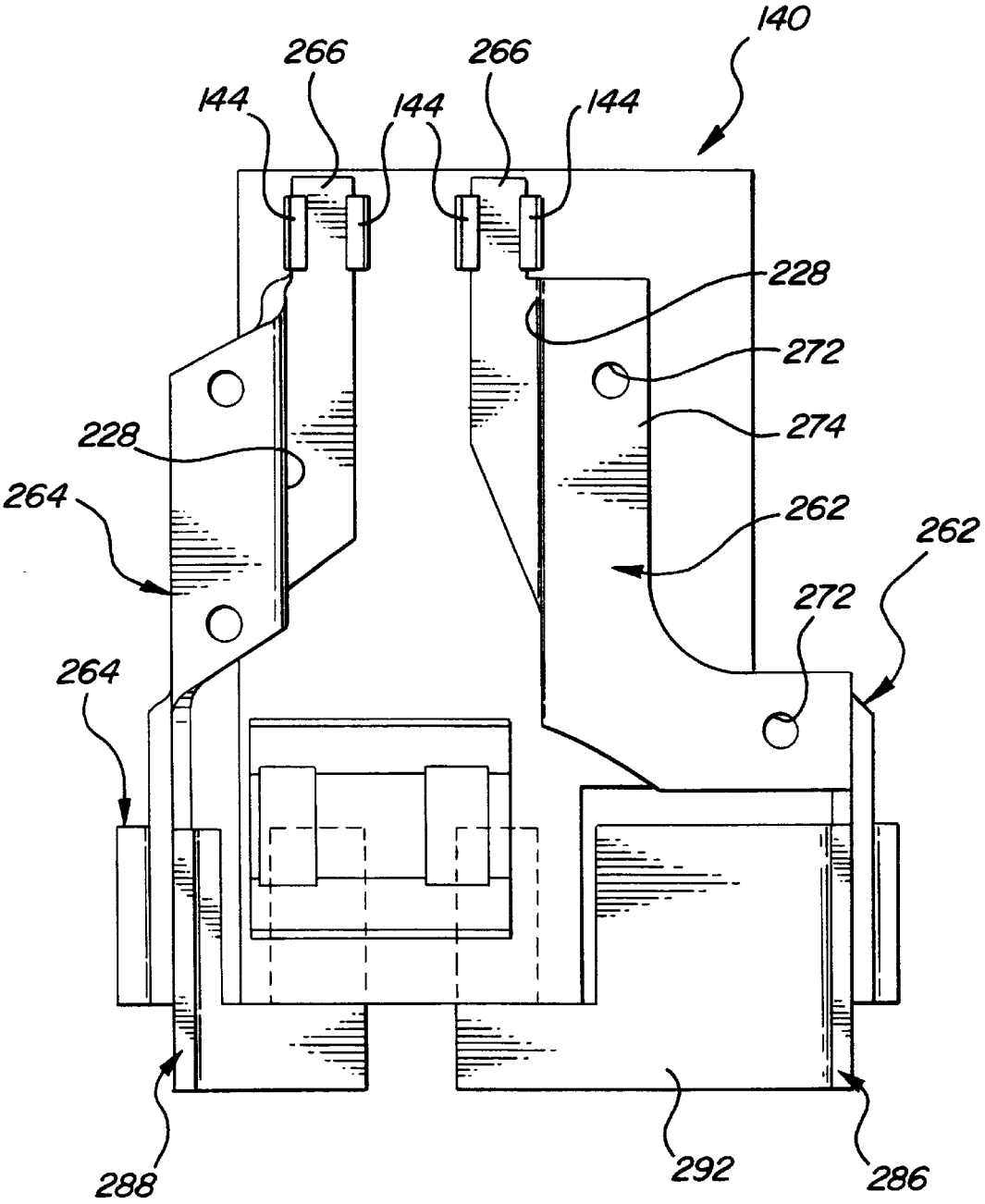
FIG. 12 is a bottom elevational view of the circuit breaker and load jaw contacts shown in FIGS. 10 and 11.

As described in the first embodiment and shown in FIG. 12, two pairs of spaced jaw contacts 144 extend outward from the bottom surface of the housing 142 of the power disconnect switch 140. The jaw contacts 144 receive the terminal ends 266 of the load conductors 262 and 264 in a snap-in connection to securely connect the load conductors 262 and 264 to the power disconnect switch 140.

The operation of the power disconnect switch or circuit breaker 140 is identical to the first embodiment described above and will not be repeated herein. It will be understood that the application of a voltage to the trigger terminals 154 and 156, such as 120 VAC or 240 VAC electrical power, will activate a coil or solenoid within the power disconnect means 140 to switch the circuit breaker contacts from a closed position to an open position. The contacts will be held in the open position, despite any effort to move the actuator 160 to the closed position, as long as electrical power is applied to the trigger terminals 154 and 165.

The connector 162 is mounted about the actuator 160 by a cotter pin, not shown. A tubular rod 163 is unitarily formed as a one piece part of the connector 162. The rod 163 projects through an aperture in the sidewall of the housing 229.

Figure 6:
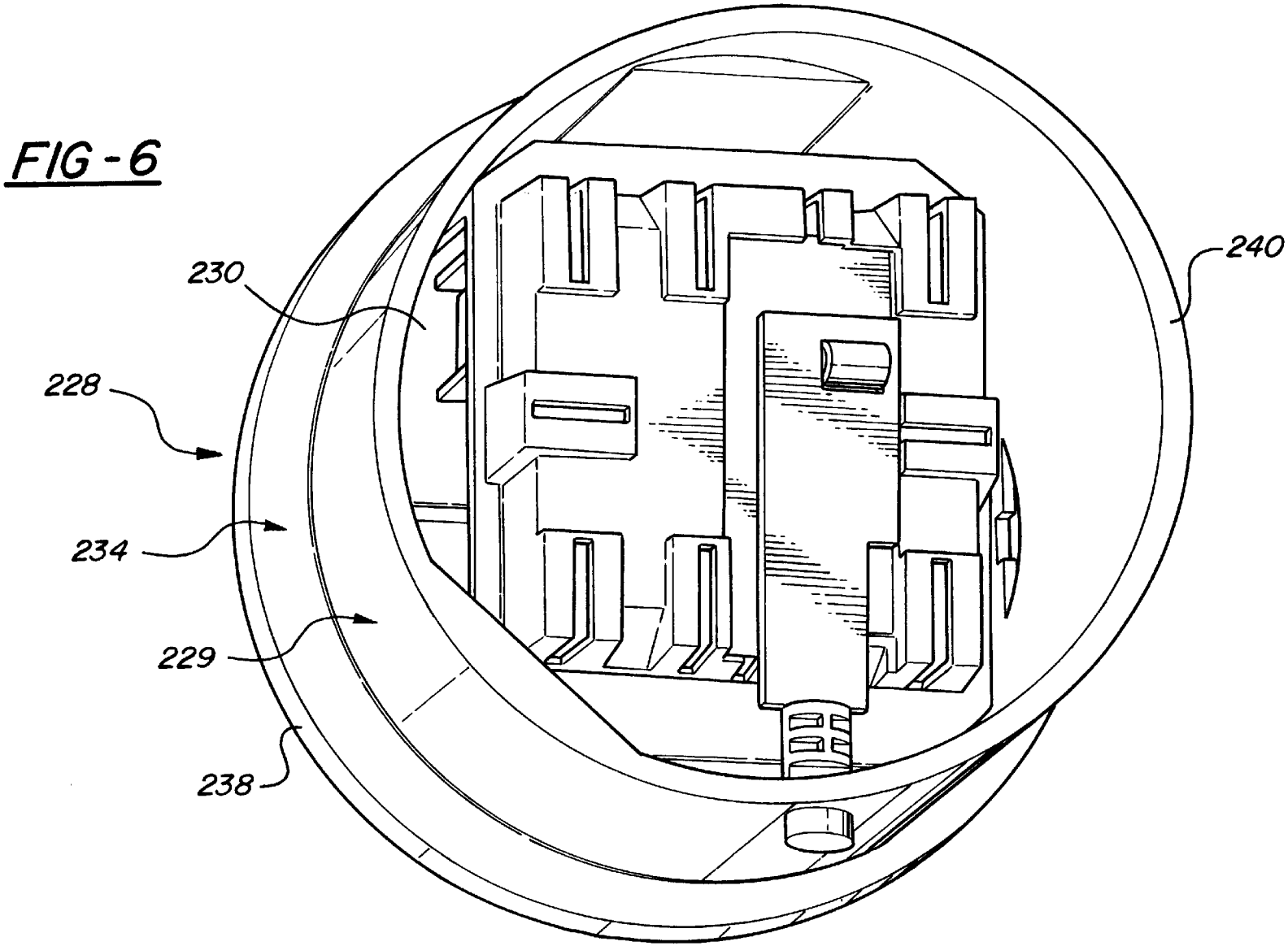
FIG. 6 is a perspective view of another embodiment of a watthour meter socket adapter having a circuit breaker switch apparatus mounted therein.
Figure 7:
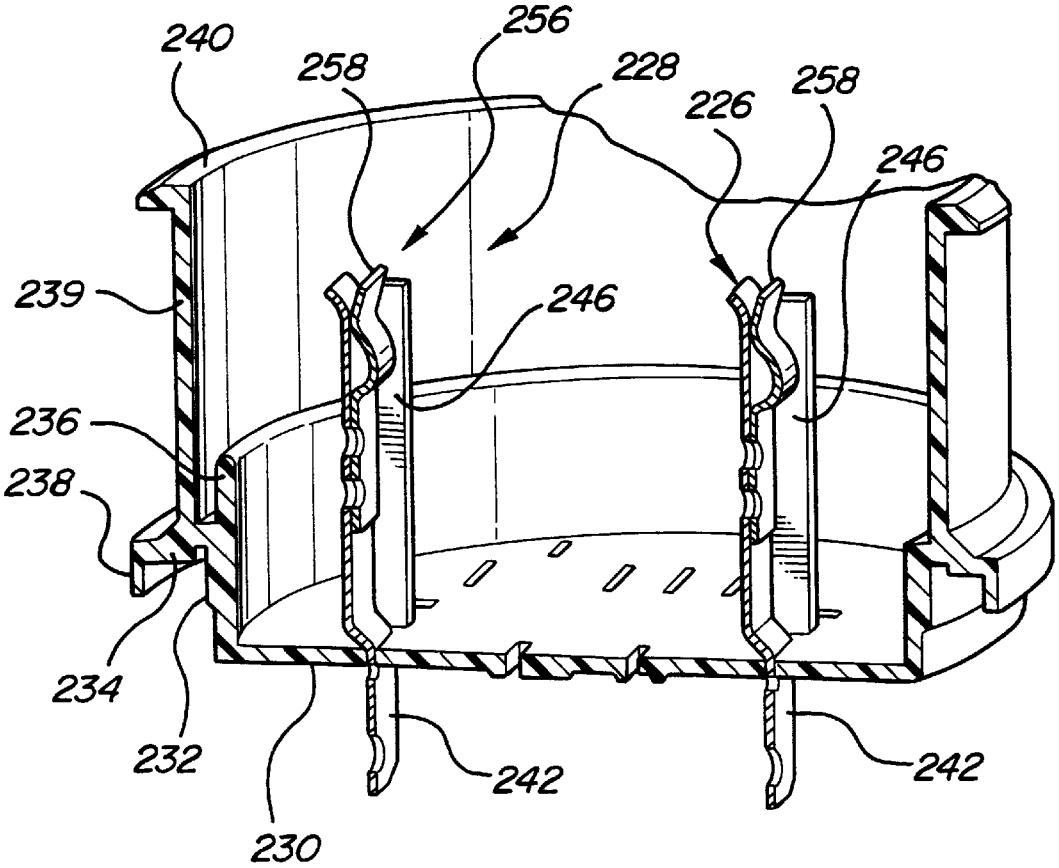
FIG. 7 is a partially cross sectioned, perspective view showing the line jaw blade terminals mounted in the socket adapter housing of FIG. 6.
Figure 8:
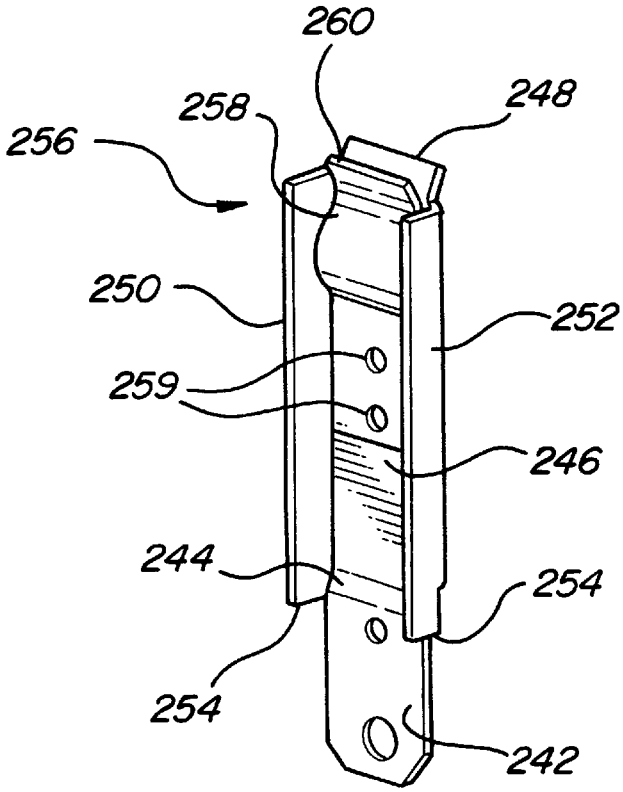
FIG. 8 is a perspective view of one of the line jaw blade terminals shown in FIG. 7.
Figure 9:
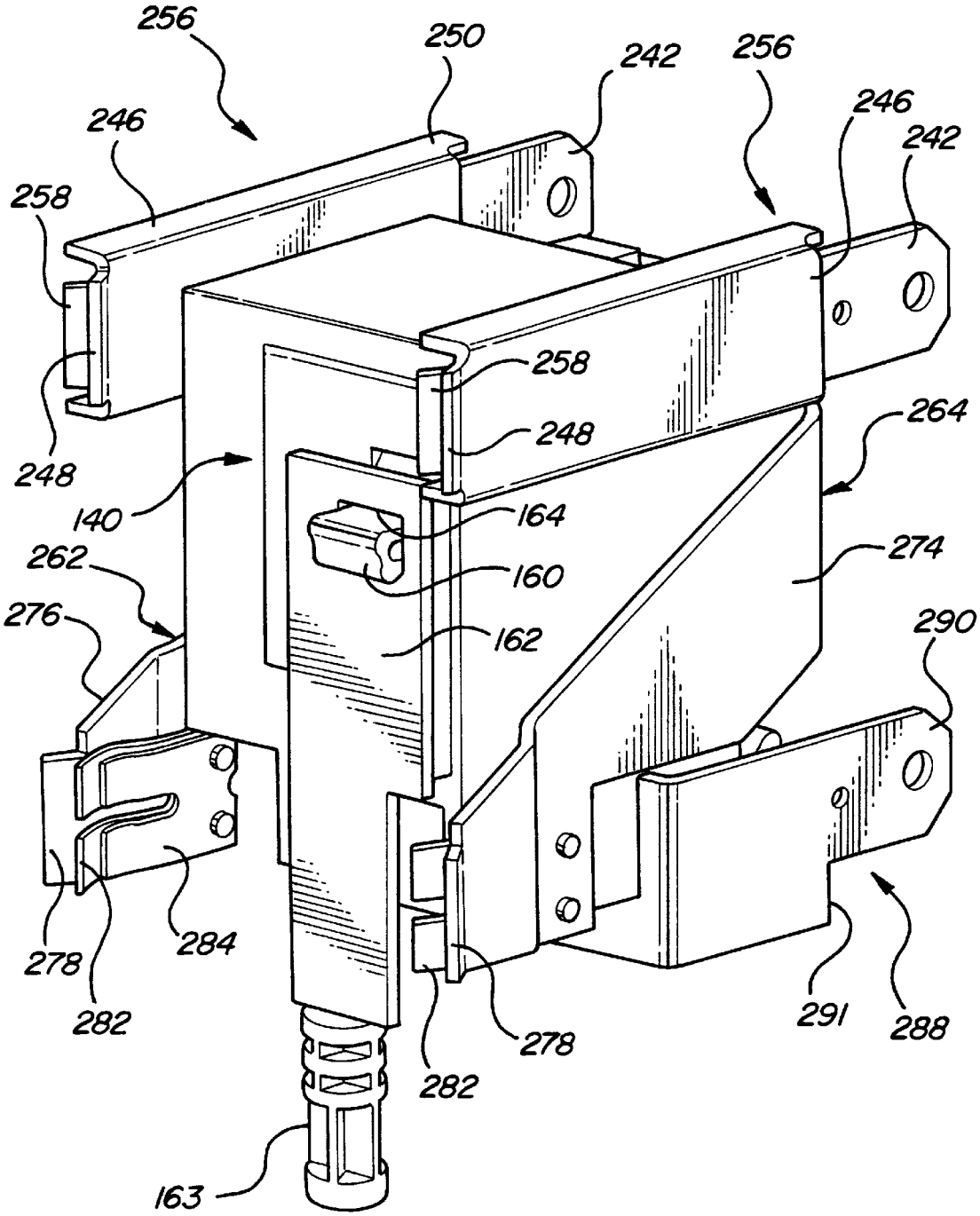
FIG. 9 is a perspective view of the circuit breaker and the socket adapter line and load jaw contacts and blade terminals.
Figure 10:
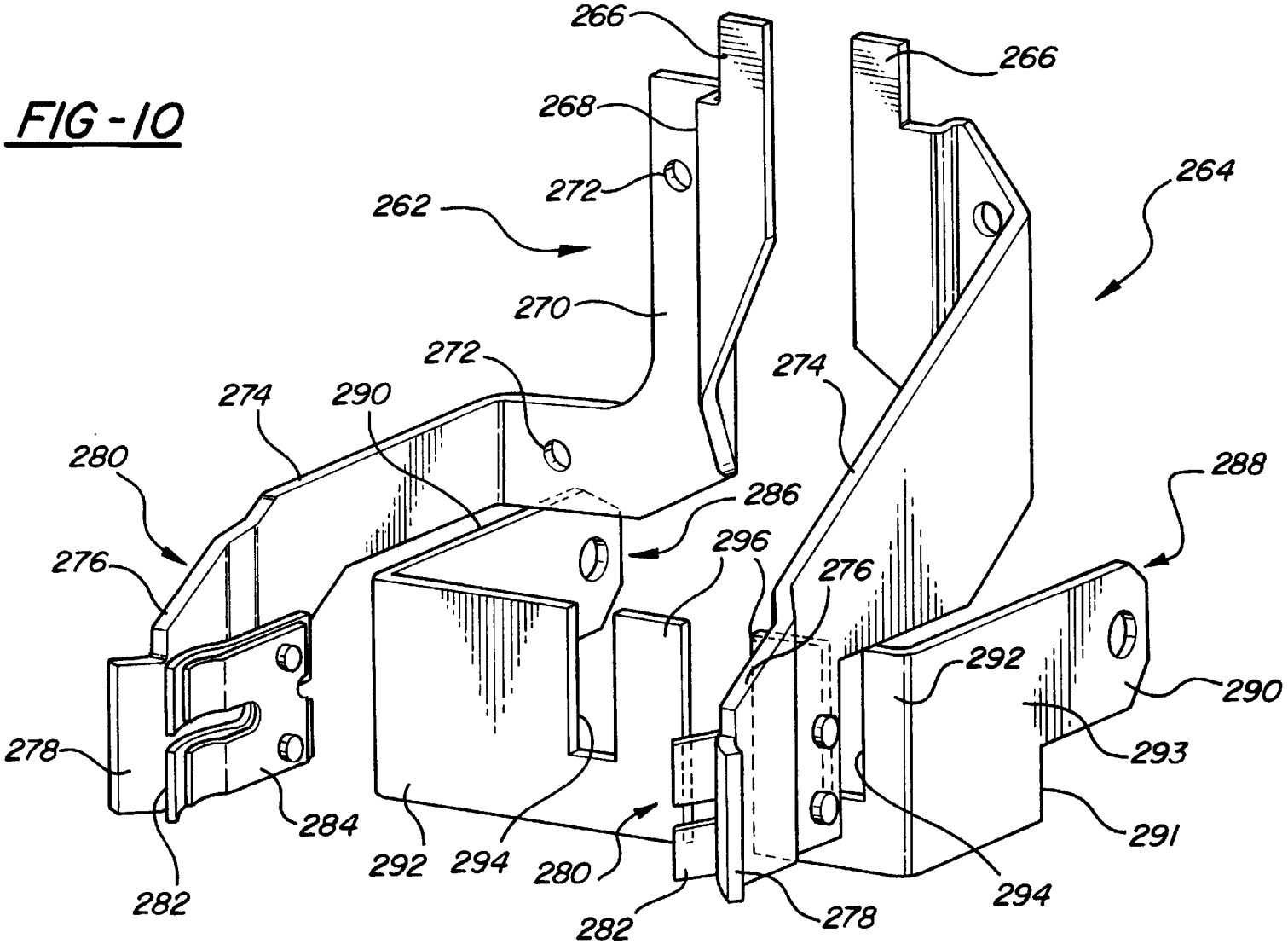
FIG. 10 is a perspective view of the load jaw contacts and the load blade terminals shown in FIG. 9.
Figure 13:
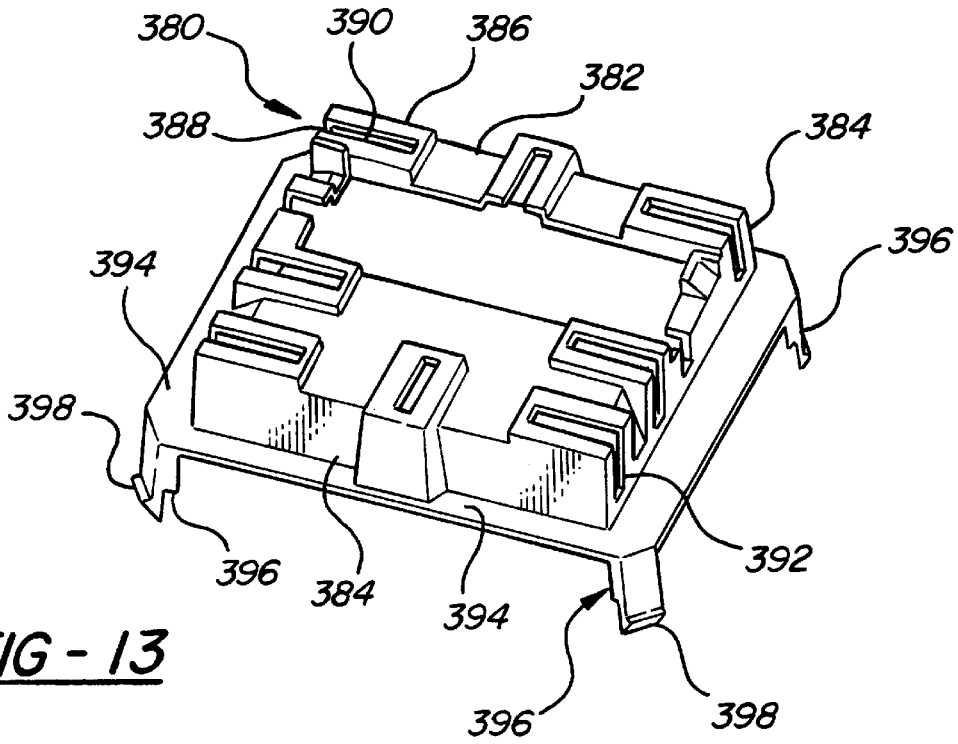
FIG. 13 is a perspective view of the safety shield shown FIG. 6.
Figure 14:
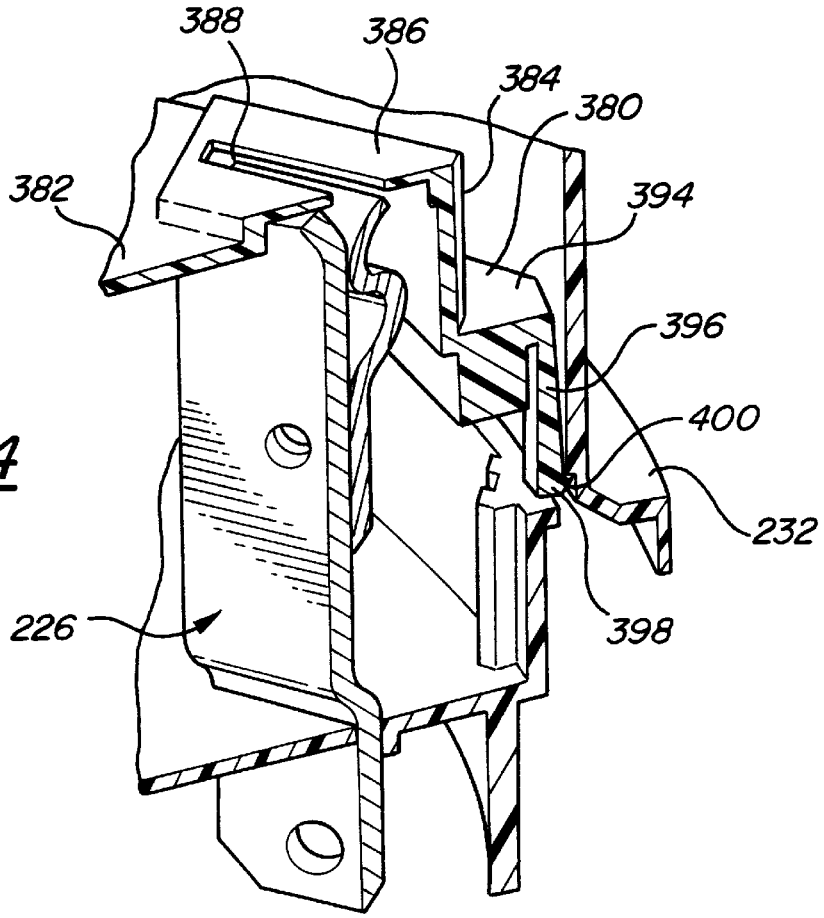
FIG. 14 is a partially cross sectioned, perspective view showing the mounting of the safety shield of FIG. 13 in the socket adapter housing.

Referring now to FIGS. 6, 13 and 14, there is depicted a jaw contact safety shield 380 which is mountable in the socket adapter 228. The safety shield 380 is formed as a one piece body of electrically insulating material, such as a suitable plastic. The safety shield 380 is formed of an enclosure which, when mounted in the socket adapter 228, completely surrounds all of the line and load jaw blades 226, 280, and conductors 286 and 288 within the socket adapter 228, except for small slots which allow the insertion of a watthour blade terminal into engagement with each line and load jaw contact 226 and 280.

The safety shield 380 includes a top or outer wall 382 and a plurality of sidewalls all denoted by reference number 384. A plurality of raised bosses 386 are formed in the top wall 382. The bosses 386 are positioned at the normal jaw contact positions of a watthour meter socket adapter.

Each boss 386 has an aperture or slot 388. Each slot 388 has a top wall portion 390 in the plane of the top wall 382 and a contiguous sidewall portion 392 forming a continuous L-shaped slot along the top wall 382 and the sidewall 384 of the safety shield 380. The provision of the sidewall portion 392 of each slot 388 simplifies the insertion and removal of watthour meter blade terminals into and out of the jaw contacts of the socket adapter 328 through the safety shield 380.

A peripheral flange 394 extends outward from a lower edge of the sidewall 384 of the safety shield 380. The peripheral flange 394 has a polygonal or square shape, by example only. Other shapes, such as octagonal, round, etc., may also be employed.

A plurality of legs 396 project from the outer corners of the safety shield 380. Each leg 396 terminates in an outwardly extending latch projection 398 which is positioned to engage an inner lip 400 formed in the sidewall 239 adjacent the mounting flange 232 as shown in FIG. 14 to releasably latch the safety shield 380 to the housing of the socket adapter extender 228. The latch projection 398 is accessible from the bottom of the mounting 232 and can be urged radially inward from the mounting flange 232 to disengage the latch projection 398 from the lip 400 and enable the safety shield 380 to be removed from the extender 228.

In summary there has been disclosed a unique circuit breaker switch apparatus including a shunt-type power disconnect switch removably mounted therein in a snap in connection in a housing which enables an electric utility or other power distribution source to regulate the power service to a user site through the simple means of providing or not providing an electric voltage or signal to the trigger terminals of the power disconnect switch.

Although described as a socket adapter having a shunt type conduit breaker mounted therein, the same teachings are applicable to a watthour meter having a shunt type circuit breaker mounted therein and connected between the line and load blades of the watthour meter. Line and load conductors connect the circuit breaker switchable contact terminals to the meter blades.

What is claimed is:

1. A circuit breaker switch apparatus mountable in a watthour meter socket, the apparatus comprising:

a housing;

line and load contact terminals mounted in the housing;

power disconnect means, disposed in the housing and having a plurality of switchable contacts switchable between an electrically conductive closed position and an electrically disconnected open position for electrically connecting at least one line contact terminal to one of the load contact terminals, the power disconnect means automatically switching the switchable contacts to the open position when the rate of power through the power disconnect means exceeds a preset level of power; and means, carried on the power disconnect means, for maintaining the switchable contacts in the open position as long as a trigger signal is applied to the power disconnect means.

2. The apparatus of claim 1 wherein the power disconnect means is a shunt power disconnect switch having trigger input terminals.

3. The apparatus of claim 1 further comprising:

means for removably mounting the power disconnect means in the housing in a removable, snap in connection.

4. The apparatus of claim 1 wherein the power disconnect means further comprises:

an actuator coupled to the switchable contacts and movable between first and second positions switching the switchable contacts between the open and closed positions, respectively;

a one piece unitary plunger coupled to the actuator and having an end slidably extending exteriorly through an aperture in the housing, the end of the plunger disposed exteriorly of the housing when the power disconnect means is in a non-power conducting state.

5. The apparatus of claim 1 wherein:

the housing comprises a base, an annular sidewall extending from the base, and a mounting flange formed on an exterior end of the sidewall.

6. The apparatus of claim 5 wherein the housing further comprises:

a mounting flange formed exteriorly of the base and the sidewall for mounting the housing to a watthour meter socket.

7. The apparatus of claim 5 wherein the base and the sidewall comprise a one piece, unitary member.

8. The apparatus of claim 1 wherein:

the housing is a socket adapter housing;

the line and load contact terminals are line and load jaw contacts and line and load blade terminals;

conductors connected to the jaw contacts and blade terminals;

an electrically insulating shield means, mounted within the housing and surrounding substantially all of the line and load jaw contacts and the line and load blade terminals, for shielding the line and load jaw contacts and the line and load blade terminals, the shield including a plurality of apertures, each aperture aligned with one of the line and load jaw contacts for allowing a watthour meter blade terminal to be inserted therethrough into contact with one of the line and load jaw contacts.

9. The apparatus of claim 8 wherein the shield further comprises:

an aperture formed in the shield for mounting the shield about the power disconnect means.

10. The apparatus of claim 1 wherein:

the load contact terminals include rigid bus bars having opposed first and second ends, the first end formed as a blade terminal, the second end connectable to the power disconnect means.

11. The apparatus of claim 1 wherein the load contact terminal further comprises:

a rigid bus bar having opposed first and second ends;

contact means, coupled to the second end for forming a jaw contact, for receiving a watthour meter blade terminal; and contact means, formed on the power disconnect means, for receiving the first ends of the bus bars in a snap-in connection.

12. The apparatus of claim 1 wherein the load contact terminal further comprises:

a rigid bus bar having first and second ends;

contact means, formed on the power disconnect means, for receiving, the first ends of the bus bar in a snap-in connection; and the second end of the bus bar connected to a blade terminal extending exteriorly of the housing.

13. The apparatus of claim 12 wherein the load contact terminal further comprises:

jaw contact means, formed on the first end of a rigid bus bar, for receiving a watthour meter blade terminal; and a second end of the bus bar connected to the power disconnect means.

14. A circuit breaker switch apparatus usable with a watthour meter socket adapter having socket jaw contacts, the apparatus comprising:

a housing;

line and load jaw contacts disposed in the housing and adapted to receive blade terminals of a watthour meter in a releasable snap in electrical connection;

line blade terminals electrically connected to the line jaw contacts and having an end portion extending exteriorly of the housing for releasable engagement with watthour meter socket jaw contacts;

load blade terminals mounted in the housing and adapted to releasably engage watthour meter socket jaw contacts;

line jaw contacts mounted in the housing for releasably engaging blade terminals of a watthour meter;

power disconnect means disposed in the housing and having a plurality of switchable contacts switchable between an electrically conductive closed position and an electrically disconnected open position;

means for electrically connecting one of the line jaw contacts and the load jaw contacts to the switchable contacts of the power disconnect means and for electrically connecting the switchable contacts of the power disconnect means to the respective one of the line blade terminals and the load blade terminals such that the position of the switchable contacts of the power disconnect means determines the application and non-application of electrical power between the line and load jaw contacts and the line and load blade terminals, respectively;

a movable external actuator carried on the power disconnect means in a plane parallel to and spaced from a base of the housing on which the power disconnect means is mounted and switchable between two positions in conjunction with switching of the switchable contacts between open and closed positions; and a one-piece plunger having one end movably disposed externally of housing of the socket adapter when the switchable contacts of the power disconnect means are in the open position, the plunger coupled to the actuator for manually moving the switchable contacts of the power disconnect means to the closed position.

15. The apparatus of claim 14 wherein the power disconnect means further comprises:

means, carried on the power disconnect means, for switching the switchable contacts from the open to the closed position upon the application of an electrical signal, the switching means continuously maintaining the switchable contacts in the open position during the duration of application of the electrical signal thereto.

16. A circuit breaker switch apparatus mountable in a watthour meter socket, the apparatus comprising:

a housing;

line and load contact terminals mounted in the housing;

power disconnect means having a plurality of switchable contacts switchable between an electrically conductive closed position and an electrically disconnected open position for electrically connecting at least one line contact terminal to one of the load contact terminals, the power disconnect means automatically switching the switchable contacts to the open position when the rate of power through the power disconnect means exceeds a preset level of power; and means for removably mounting the power disconnect means in the housing in a snap-in connection.

17. The apparatus of claim 16 wherein the mounting means further comprises:

a rigid bus bar having first and second ends;

contact means, formed on the power disconnect means for receiving the first end of the bus bar in a snap-in connection; and the second end of the bus bar connected to a blade terminal extending exteriorly of the housing.

18. A circuit breaker switch apparatus mountable in a watthour meter socket adapter, the apparatus comprising:

a housing;

line and load contact terminals mounted in the housing;

conductors connected to the line and load contact terminals;

power disconnect means, disposed in the housing and having a plurality of switchable contacts switchable between an electrically conductive closed position and an electrically disconnected open position for electrically connecting two of the line contact terminals and the load contact terminals, the power disconnect means automatically switching the switchable contacts to the open position when the rate of power through the power disconnect means exceeds a preset level of power; and an electrically insulating shield means, mounted within the housing and surrounding substantially all of the line and load contact terminals, for shielding the line and load contact terminals, the shield including a plurality of apertures, each aperture aligned with one of the line and load contact terminals for allowing a watthour meter blade terminal to be inserted therethrough into contact with one of the line and load contact terminals, the shield means having a cutout on one surface, the cutout exposing the power disconnect means.

* * * * *